US009285138B1

(12) United States Patent
Sasser

(10) Patent No.: US 9,285,138 B1
(45) Date of Patent: Mar. 15, 2016

(54) MOBILE HEATER AND FAN SYSTEM AND METHODS OF COMMISSIONING A DATA CENTER

(71) Applicant: McKinstry Co., LLC, Seattle, WA (US)

(72) Inventor: John D. Sasser, Seattle, WA (US)

(73) Assignee: McKinstry Co., LLC, Seattle, WA (US)

( * ) Notice: Subject to any disclaimer, the term of this patent is extended or adjusted under 35 U.S.C. 154(b) by 5 days.

(21) Appl. No.: 14/491,466

(22) Filed: Sep. 19, 2014

(51) Int. Cl.
*F24D 15/02* (2006.01)
*F24H 9/20* (2006.01)
*F24H 3/02* (2006.01)

(52) U.S. Cl.
CPC ..... *F24H 9/2071* (2013.01); *F24H 3/022* (2013.01); *F24H 2250/02* (2013.01)

(58) Field of Classification Search
CPC ... F24H 3/0417; F24H 3/0411; F24H 9/1872; F24H 3/0405; F24H 9/2071
USPC ..... 392/360–369, 383, 373–374, 411, 417; 219/533, 506, 501, 480, 486, 492, 485, 219/497, 483, 494, 388
See application file for complete search history.

(56) References Cited

U.S. PATENT DOCUMENTS

| | | | | |
|---|---|---|---|---|
| 3,176,117 | A * | 3/1965 | Knoll et al. | 392/360 |
| 5,528,016 | A * | 6/1996 | Mogi | 219/486 |
| 5,853,441 | A * | 12/1998 | Groen et al. | 55/350.1 |
| 7,190,887 | B1 * | 3/2007 | Compton | 392/365 |
| 2007/0171613 | A1 * | 7/2007 | McMahan et al. | 361/695 |
| 2011/0019362 | A1 * | 1/2011 | Krietzman | 361/690 |

* cited by examiner

*Primary Examiner* — Phuong Nguyen
(74) *Attorney, Agent, or Firm* — Lowe Graham Jones PLLC

(57) ABSTRACT

A mobile system for simulating a thermal load and airflow expected in the operation of a data center includes a thermal energy source, an impeller and impeller drive unit, an outlet port, a frame and a ground engaging member. The thermal energy source provides thermal energy to air adjacent to the thermal energy source. The impeller controls a flow rate of air adjacent to the adjacent to the thermal energy source. The outlet port outputs the flowing air. The impeller drive unit drives the impeller at a frequency based on a determined airflow at the outlet port. The frame supports the thermal energy source, the impeller, the output port and the drive unit. The ground engaging member supports the frame and enables the mobility of the system.

10 Claims, 9 Drawing Sheets

MOBILE HEATER AND FAN SYSTEM AND METHODS OF COMMISSIONING A DATA CENTER

TECHNICAL FIELD OF THE INVENTION

The disclosure relates generally to commissioning data centers and specifically to a mobile system employed to simulate an expected thermal and airflow load associated with a data center.

BACKGROUND OF THE INVENTION

Modern data centers often include a substantial volume of electronic hardware components, such as processor, storage and packet management devices, and the like. Some of these devices generate heat when operated. For instance, a Blade Server system generates significant amounts of heat. Furthermore, the faster the devices are operated, generally the more heat generated. Because these devices are packaged in ever-increasing densities and operated at ever-increasing speeds, the heat density within operating data centers is increasing.

For those that design, build and operate data centers, dissipating this heat is a significant issue. Failure to adequately dissipate the heat may cause the electronics within the data center to malfunction or catastrophically fail. Such scenarios can lead to the disruption or downtime of the services provided by the data center. Disruption of data centers, even for a short amount of time, can lead to significant decreases in revenue. In the last several years, data center designers have implemented physical containment strategies as an efficiency strategy. Containment strategies include placing physical barriers to prevent the conditioned computer inlet air from mixing with the heated server exhaust air.

Accordingly, the heating, ventilation and air conditioning (HVAC) system of a facility must be designed to adequately dissipate the heat generated during the data center's operation. In a data center using containment, it is important to ensure that the HVAC system can produce sufficient airflow to deliver the rated cooling. Furthermore, testing the facility's HVAC system prior to installing the heat generating electronic components is desired. Accordingly, a need exists to simulate the expected heat generation of data centers without having to install and operate the associated electronics.

It has long been customary for organizations testing the data center's HVAC and electrical systems to use portable load banks. The load banks generate heat, but they do not adequately test airflow. There are also relatively small (4000 CFM) fan devices which can be mounted in server cabinets and simulate the server airflow. Typically, when a facility such as this is commissioned, there are no server cabinets, so it is impractical to use these small, cabinet-mounted fans. It is for these and other concerns that the following disclosure is offered.

SUMMARY OF THE INVENTION

The present disclosure is directed towards mobile systems and methods of operating the mobile systems for simulating expected thermal loads. A first embodiment of a mobile system for simulating a thermal load expected in the operation of a data center includes a thermal energy source, an impeller and an outlet port. The system may include an impeller drive unit, a frame and at least one ground-engaging member. The thermal energy source provides thermal energy to air adjacent to the thermal energy source. The impeller controls a flow rate of air adjacent to the thermal energy source. The outlet port dispenses or outputs the flowing air. The impeller drive unit drives the impeller at a frequency based on a determined airflow at the outlet port. The frame supports the thermal energy source, the impeller, the output port and the drive unit. The ground-engaging member supports the frame and enables the mobility of the system.

In at least one embodiment, the system includes a duct to direct the flowing air through the output port. The system may include a thermal energy source drive unit. The thermal energy source drive unit controls an amount of thermal energy provided to the air adjacent to the thermal energy source based on a predetermined temperature of the air outputted at the output port. The system includes an interlock switch that inhibits an operation of the thermal energy source, for example, when a temperature of the thermal energy source is greater than a predetermined temperature threshold or airflow across the thermal energy source is less than a predetermined airflow threshold.

A vertical height of the output port is adjustable. This provides various benefits, for example, it allows the output port to be connected to a ceiling plenum, when testing calls for it. Various embodiments include a variable length power cord to provide electrical power. The system is mobile during operation of the system. A cross section of the output port is adjustable. Various embodiments include a safety grate to protect at least one of the impeller or the thermal energy source. The system includes a collapsible duct to accommodate a variable height of the frame.

A method for commissioning a data center includes determining an expected air temperature based on a hardware utilization factor. The method includes determining an expected airflow based on the hardware utilization. In various embodiments, the method includes controlling a thermal energy source based on the expected air temperature. The method may include providing a signal to drive an impeller and induce airflow of the heater air based on the expected airflow.

In some embodiments, the thermal energy source and the impeller are integrated with a mobile cart. A variable frequency drive (VFD) provides the signal. The method may include controlling a frequency of the signal provided by the VFD based on an actual airflow. The method includes inhibiting the operation of the thermal energy source when at least a temperature of the thermal energy source is greater than a predetermined temperature threshold or airflow across the thermal energy source is less than a predetermined airflow threshold.

In various embodiments, a cart for commissioning a data center includes a duct, a duct heater, a fan, an output port, a frame and a plurality of wheels. The duct heater heats air flowing through the duct. The fan induces the flow of air through the duct. The output port is coupled to the duct. The frame supports the duct, the duct heater, the fan and the output port. The wheels support the frame and enable the translation of the cart to a plurality of positions within the data center.

A vertical height of the frame is adjustable to enable a user to vary the vertical position of the output port. An effective length of a portion of the duct is adjustable to accommodate a variable vertical height of the output port. In at least one embodiment, the cart includes a VFD to drive the fan at a variable frequency based on the induced airflow through the duct.

In at least one embodiment, the cart includes a switch that prevents the operation of the duct heater, for example when a temperature of the duct heater is greater than a predetermined temperature threshold or an airflow across the duct heater is less than a predetermined airflow threshold. The duct and the fan may be oriented such that the flow of air through the duct is substantially a vertical flow of air.

BRIEF DESCRIPTION OF THE DRAWINGS

Preferred and alternative examples of the present invention are described in detail below with reference to the following drawings, each of which is consistent with embodiments disclosed herein.

DETAILED DESCRIPTION OF THE PREFERRED EMBODIMENT

To facilitate the understanding of this invention, a number of terms are defined below. Terms defined herein have meanings as commonly understood by a person of ordinary skill in the areas relevant to the present invention. Terms such as "a," "an" and "the" are not intended to refer to only a singular entity, but include the general class of which a specific example may be used for illustration. The terminology herein is used to describe specific embodiments of the invention, but their usage does not delimit the invention, except as outlined in the claims.

Figure 1A:
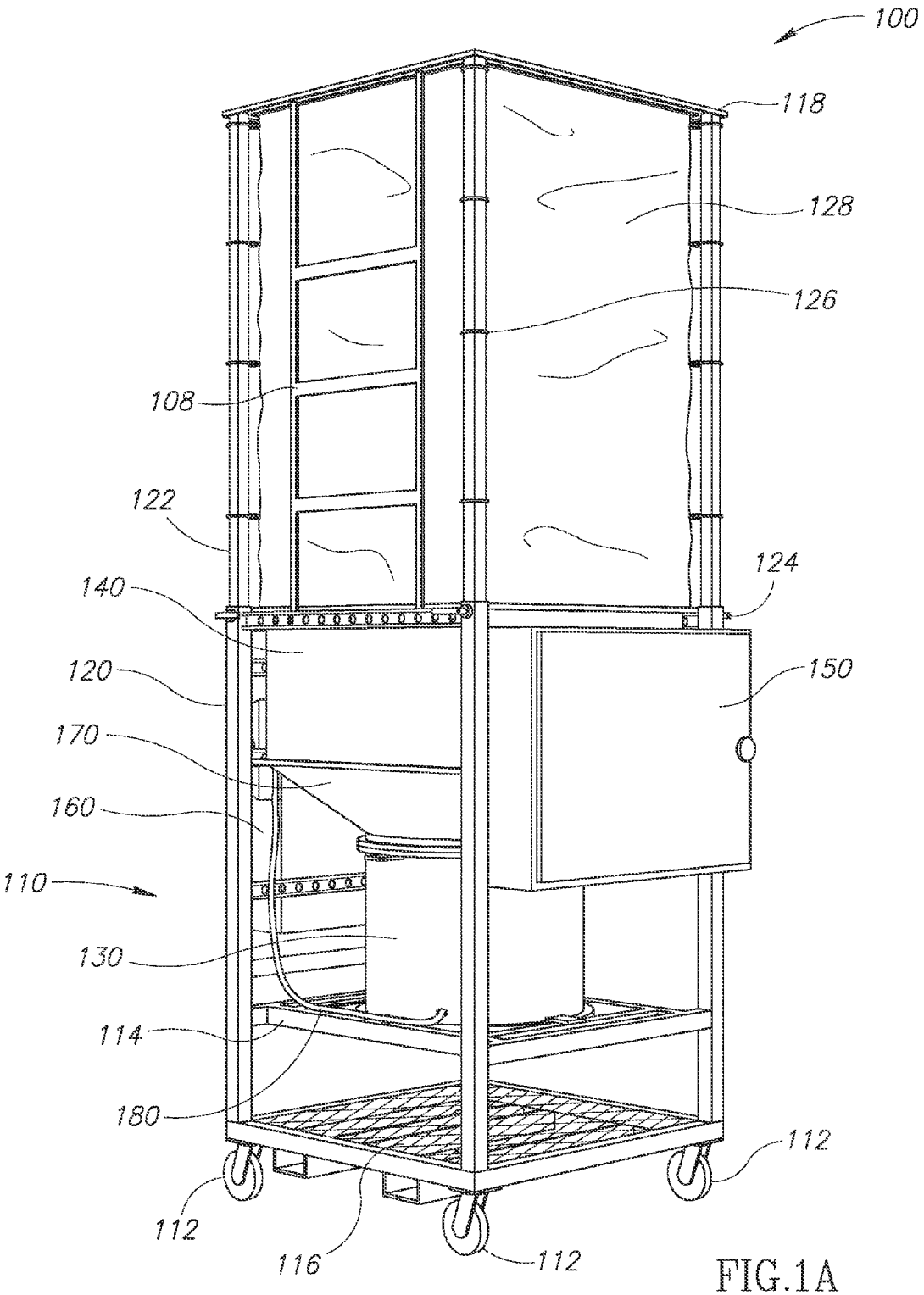
FIG. 1A illustrates an isometric view of a mobile system used to simulate thermal loads generated by electronic hardware devices.

FIG. 1A illustrates an isometric view of a mobile system used to simulate thermal loads generated by electronic hardware devices. Such heat generating devices include, but are not limited to, server, storage and packet management devices, and the like. Although embodiments discussed herein are employed in the context of commissioning a data center, it is to be understood that the various embodiments are not so constrained. Rather, the mobile system actively controls the generation and flow rate of thermal energy. Accordingly, the system may be employed in the commissioning of a data center or in any other scenario where the generation of thermal energy is required and/or useful.

The system generates the expected thermal energy and/or thermal load associated with the operation of various electronic hardware devices and provides the generated heat to various locations within a potential data center facility. Thus, during the commissioning of a data center, the system is used to simulate the thermal loads expected during the operation of the data center. Prior to installing the heat generating hardware, tests may be performed to determine whether the airflow within a potential facility is adequate to dissipate the expected thermal loads. Furthermore, without installing the hardware, the heating, ventilation, and air-conditioning (HVAC) system of a facility may be tested in view of the expected thermal and airflow loads of the data center. For instance, it may be determined whether the facility's HVAC system can withstand the expected thermal and airflow loads during expected peak operation of the data center.

The system actively controls the output of the generated thermal energy by varying the temperature and flow rate of air flowing through an output port. The temperature and flow rate may be actively monitored in real time. Accordingly, a temperature feedback loop is employable to ensure that the system's actual generated temperature corresponds to the expected temperature associated with the data center's expected thermal load. Likewise, a flow rate feedback loop is employable to ensure that the system's actual generated flow rate corresponds to the expected flow rate associated with the data center's expected thermal load. At least one of the air temperature feedback loop or the airflow feedback loop is at least partially implemented by a processor device include in the system.

The heat generating hardware within a data center may be distributed non-uniformly across the facility. Thus, the expected thermal loads may vary as a function of position within the facility. Because of the mobility of the system, the location of the system within the facility is easily varied. The control of the temperature and flow rate may be a function of location to simulate the non-uniform distribution of hardware across the facility. In this way, the thermal load actually generated by the system substantially corresponds to, as well as accurately and precisely simulates, the data center's expected thermal load as a function of position throughout the potential facility.

In at least one embodiment, multiple systems may be simultaneously positioned and operated across the facility to simulate the expected thermal load across the facility. Embodiments of the system include a variable length power cord to provide electrical power to the system in a range of positions within the facility. The power cord provides power to the system directly from the facility's power distribution units (PDUs). In a preferred embodiment, the system's power cord is at least 40 feet long.

Mobile system 100 includes frame 110. FIG. 1A details a non-limiting exemplary embodiment of a system frame. Frame 110 includes at least one ground-engaging member, such as wheels 112. The ground-engaging members enable the mobility of mobile system 100. In a preferred embodiment, wheels 112 are caster-style wheels. However, other embodiments are not so constrained and may employ other styles of wheels.

Caster-style wheels provide at least a partial rotation about a pivot rotational axis that is substantially vertical and orthogonal to wheel's 112 horizontal rolling rotational axis. The pivot rotational axis enables system 100 to translate in any direction on a two-dimensional surface, such as the floor of a potential data center facility. In a preferred embodiment, frame 110 includes four ground-engaging members. It should be appreciated that greater or less than four ground-engaging members may be included with frame 110.

In some embodiments, frame 110 includes horizontal lower shelf 116. Lower shelf 116 may be used to support or hold various items, such as tools, electronic devices and/or meters, data logbooks, and the like. Frame 110 includes vertical members 120, which extend generally upward in the vertical direction and define an upper frame portion 118. In a preferred embodiment, the horizontal cross section of upper frame portion 118 defines the output port of system 100, and the horizontal cross section is approximately 48 inches by 48 inches. In at least one embodiment, the cross section of the output aperture is adjustable, for example, to include any desired shape and/or any desired linear dimensions.

Figure 1B:
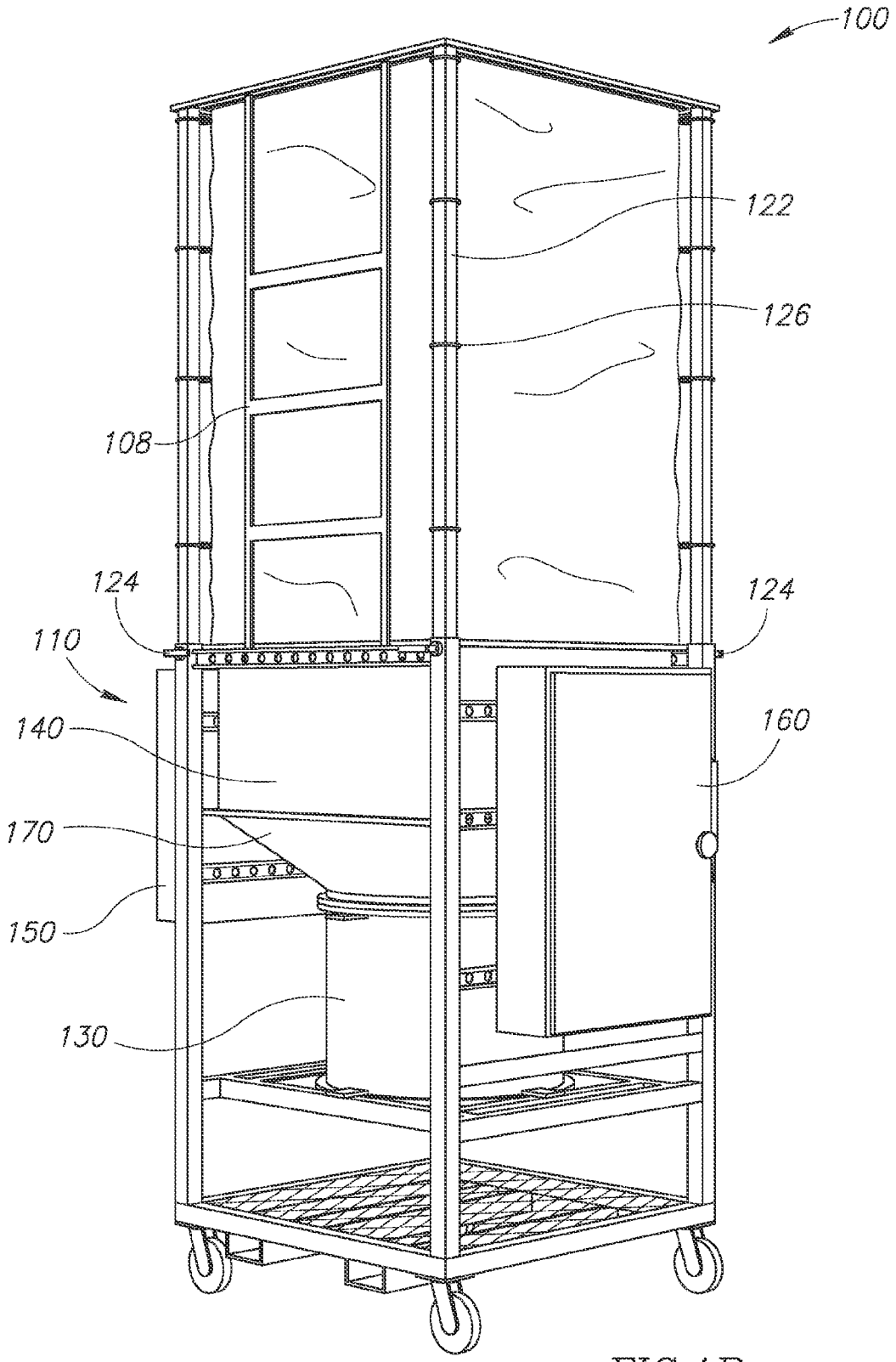
FIG. 1B illustrates another isometric view of a mobile system used to simulate thermal loads generated by electronic hardware devices.
Figure 7:
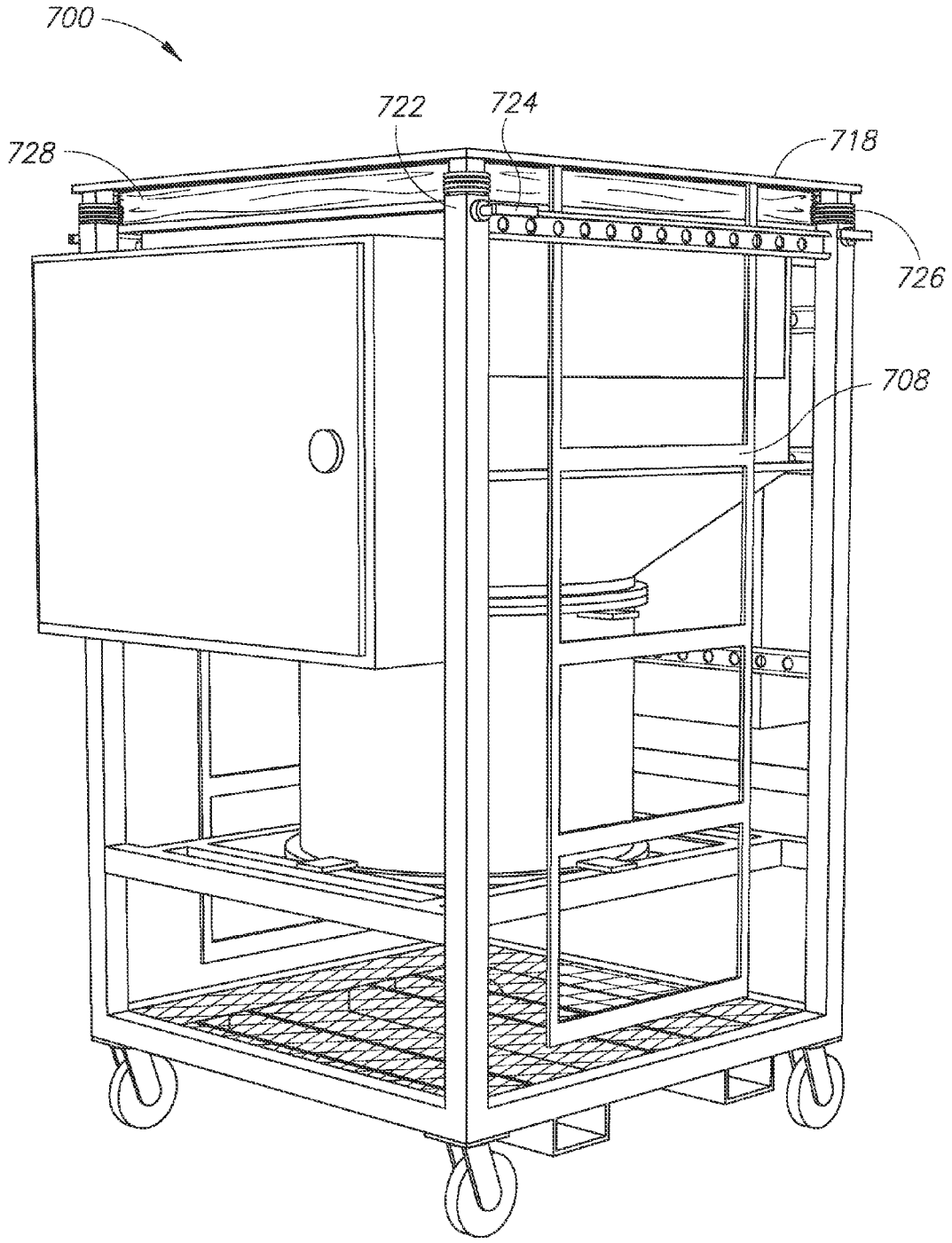
FIG. 7 illustrates an isometric view of a mobile system where the vertical height of the output port is adjusted to a minimum height.

Telescoping vertical members 122 enable the adjustment of the vertical height of upper frame portion 118. Accordingly, the vertical height of the output port of system 100 is adjustable. Because the height of the output port is adjustable, system 100 may accommodate facilities with varying ceiling heights or varying heights of HVAC system ducts. FIGS. 1A and 1B illustrate a maximally adjusted height of upper frame portion 118 and output port. FIG. 7 shows another embodiment of a mobile system where the vertical height of the frame is adjusted to a lower height. In preferred embodiments, the vertical height of the upper frame portion 118 is continuously adjustable between a range of 78 and 144 inches. It should be understood that other ranges of adjustment are possible. In at least one embodiment, the adjustability of the vertical height of frame 110 is not continuous, but rather the possible vertical heights occur in discreet steps.

Levers 124 secure or lock down the telescoping vertical members 122 such that the vertical height of the output port stabilized. When levers 124 are loosened, a frame handle 108 enables a user to easily manipulate telescoping vertical members 122 up and down to adjust the vertical height of upper frame portion 118. A flexible or collapsible duct portion 128 accommodates the varying vertical height of frame 110. A plurality of couplers or fasteners, such as pins 126, secures the collapsible duct portion 128 to the telescoping vertical members 122.

Figure 4A:
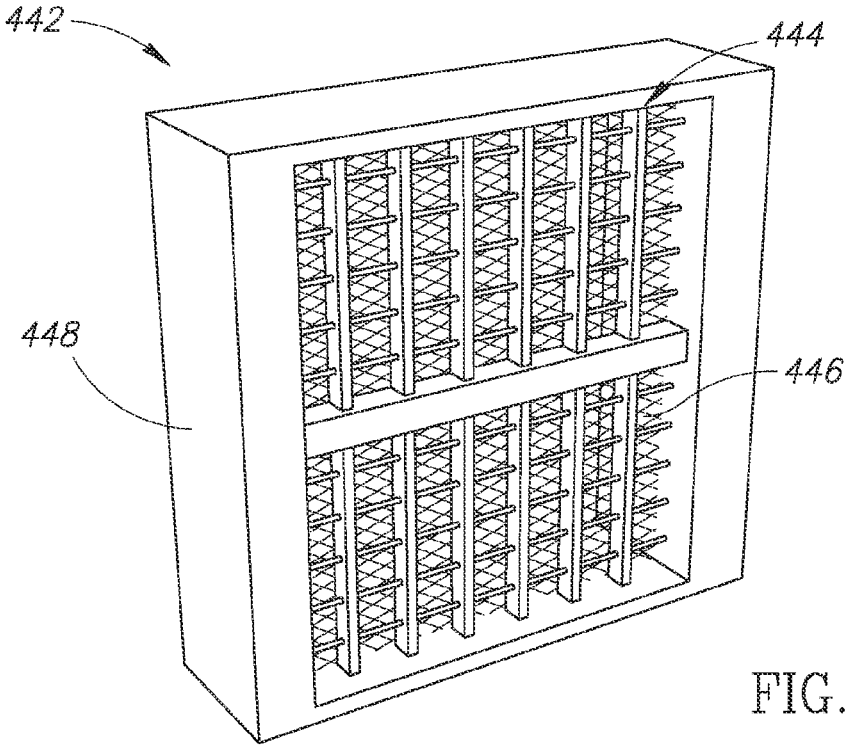
FIG. 4A shows a thermal energy source included in a mobile system used to simulate thermal loads generated by electronic hardware devices.

Mobile system 100 includes a thermal energy source, such as a duct heater assembly, which generates thermal energy. The thermal energy source is supported by frame 110. In the embodiment illustrated in FIGS. 1A and 1B, the thermal energy source is positioned within air duct 140 (thus not shown). FIG. 4A shows one embodiment of a duct heater. However, it is to be understood that the various embodiments are not limited to a duct heater, and any thermal energy source may be used.

The thermal energy source generates thermal energy and transfers the thermal energy to the air within air duct 140, thereby increasing the temperature of the air within the air duct. In a preferred embodiment, the thermal energy source is enabled to output at least 100 kW of thermal power, although other embodiments are not so constrained.

The thermal energy source control panel 150 houses the electronic components required to control the thermal energy source. The thermal energy source may be at least partially controlled by a processor device included in system 100. The electronic components housed within thermal energy source control panel 150 enable the control and real time adjustment of the temperature of the air flowing through the output port, within a predetermined range. The thermal energy source is controlled in stages and is adjustable to match the corresponding expected thermal load of the data center. In a preferred embodiment, the thermal energy source in enabled to provide at least a 20 degree Fahrenheit temperature differential between the air flowing through the output port and the ambient air temperature. It is recognized that other embodiments are not so constrained, and greater maximum temperature differentials are possible.

The temperature of the air flowing through the output port may be monitored in real time during the operation of system 100. The power output of the thermal energy source may be adjusted based on the actual temperature of the air flowing through the output port. This allows for real time temperature feedback and enables the accurate simulation of the expected temperatures from the data center's electronic hardware components.

Mobile system 100 includes an airflow assembly 130. In various embodiments, airflow assembly 130 is a fan. Frame 110 supports airflow assembly 130. Specifically, the frame 110 includes a shelf 114 that may at least partially support airflow assembly 130. Airflow assembly 130 includes an impeller to create or induce a flow of fluid, such as the air within air duct 140. Airflow assembly 130 may include an energy convertor, such as an electric motor, to convert electrical energy into mechanical work and drive or rotate the impeller.

In a preferred embodiment, the airflow assembly 130 and the thermal energy source are integrated such that airflow assembly 130 induces an airflow of the energized or heated air through air duct 140. As shown in FIG. 1A, the airflow through mobile system 100 is substantially a vertical airflow in an upward direction. In various embodiments, the upward direction is substantially defined by a vector originating along a rotational axis of airflow assembly 130 and terminating at the output port, such that air flows up and out of the mobile system 100 and in a generally vertically upward fashion.

Figure 3:
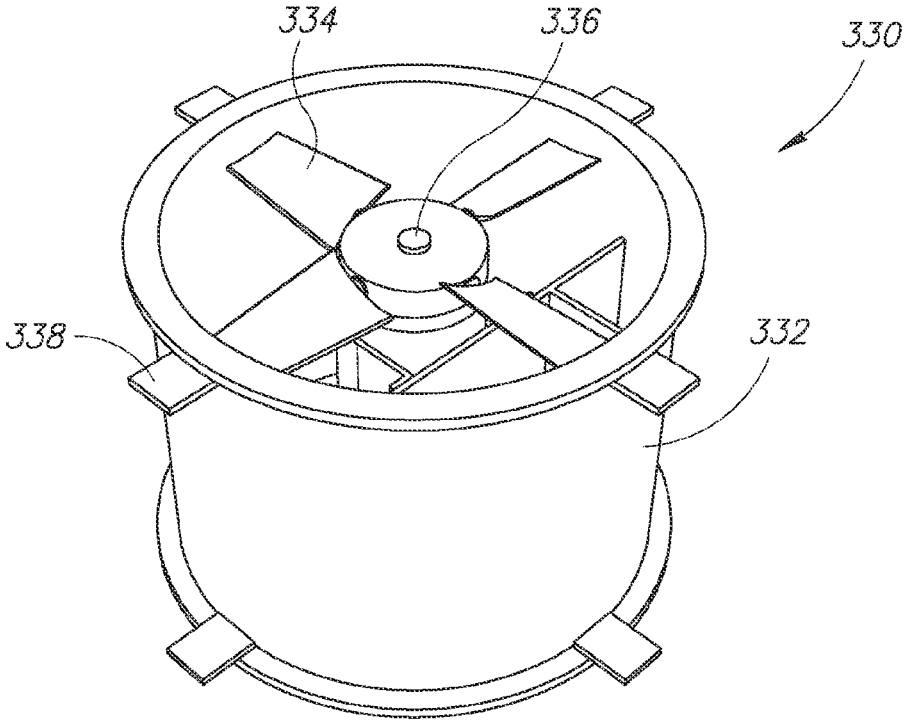
FIG. 3 shows an airflow assembly included in a mobile system used to simulate thermal loads generated by electronic hardware devices.

In various embodiments, airflow assembly 130 may be operated without the thermal energy source generating thermal energy. In such operational modes, the temperature of the air flowing out of the output aperture would be substantially equivalent to the ambient air temperature. FIG. 3 shows a non-limiting exemplary embodiment of a fan assembly. In a preferred embodiment, the airflow assembly is enabled to output at least 17,000 cubic feet per minute (CFM) of air through the outlet port, although other embodiments are not so constrained.

Figure 6:
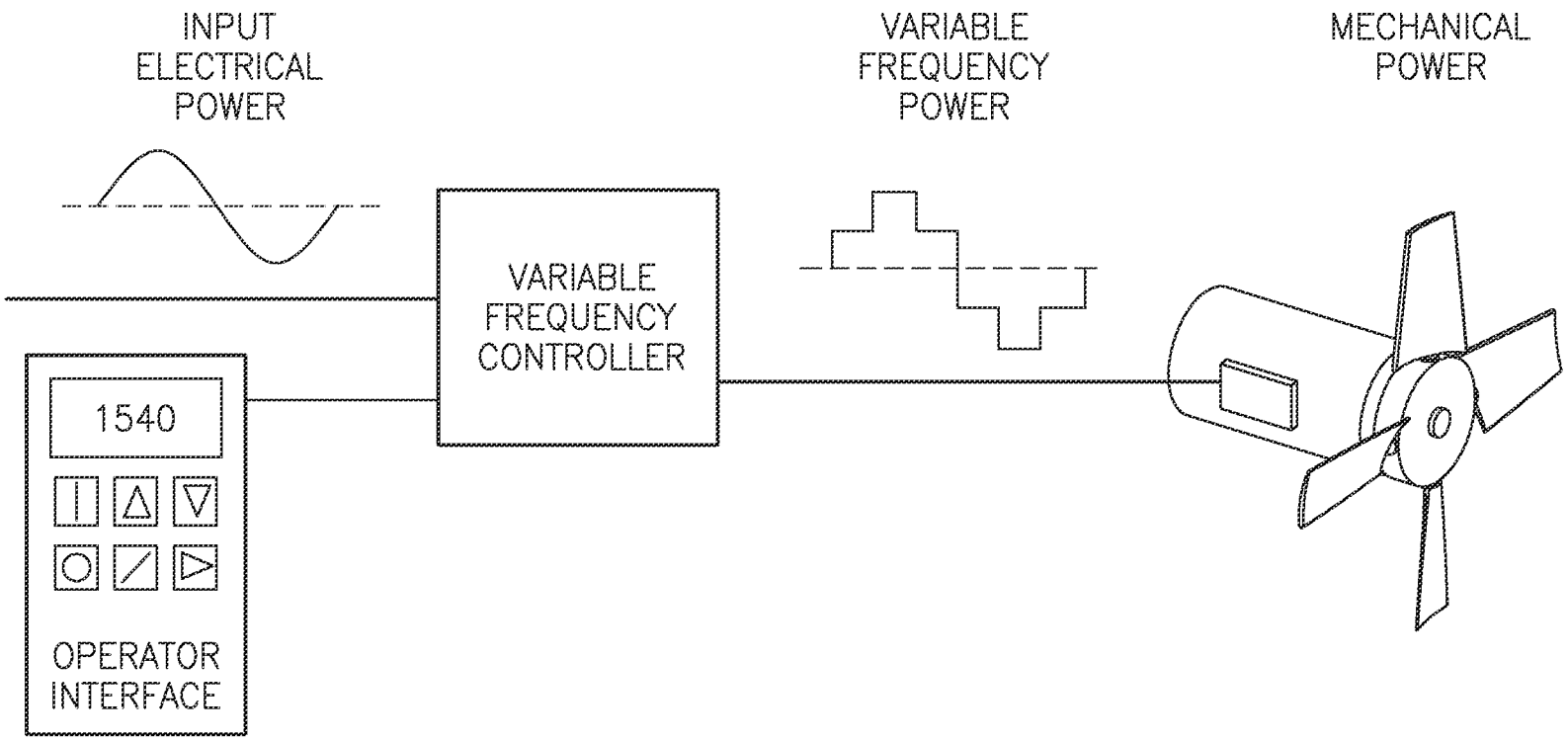
FIG. 6 shows a schematic view of a variable frequency drive unit (VFD) included in a mobile system used to simulate thermal loads generated by electronic hardware devices.

With reference again to FIGS. 1A and 1B, airflow assembly control panel 160 houses the electronic components required to control airflow assembly 130. The electronic components housed within airflow assembly control panel 160 enable the control and real time adjustment of the flow rate of the air flowing through the output port within a predetermined range. In various embodiments, airflow assembly control panel 160 houses a variable frequency drive unit (VFD) to drive the impeller of airflow assembly 130 at variable frequency and vary the flow rate of air flowing through the output port. FIG. 6 illustrates a schematic embodiment of a VFD. In other embodiments, the VFD is housed at other locations on frame 100. The VFD may include a processor device to at least partially control airflow assembly 130.

The airflow assembly 130 may be controlled to substantially match the expected airflow corresponding to the expected thermal load of the data center. For instance, the VFD varies the frequency of an alternating current (AC) signal provided to an electric motor that drives the impeller of airflow assembly 130. In a preferred embodiment, the thermal energy source is enabled to provide at least a 20 degree Fahrenheit temperature differential between the air flowing through the output port and the ambient air temperature at a flow rate of at least 15,800 CFM.

The flow rate of the air flowing through the output port may be monitored in real time during the operation of system 100.

The VFD enables the adjustment of the impeller frequency based on the actual flow rate of the air flowing through the output port. This allows for real time flow rate feedback and enables the accurate simulation of the expected flow rate from the data center's electronic hardware components.

In a preferred embodiment, system 100 includes a safety interlock pressure switch that prevents the thermal energy source from getting too hot without adequate airflow across the thermal energy source. For instance, the interlock may power down the thermal energy source when either the temperature of the thermal energy source is greater than a predetermined temperature threshold or the flow rate of air across the thermal energy source is less than a predetermined flow rate threshold. The interlock prevents thermal damage to the thermal energy source. A power cord 180 provides power from airflow assembly control panel 160 to airflow assembly 130. An integrating duct 170 integrates or couples air duct 140 to airflow assembly 130.

FIG. 1B illustrates another isometric view of a mobile system used to simulate thermal loads generated by electronic hardware devices. As compared to FIG. 1A, system 100 in FIG. 1B is rotated to clearly show airflow assembly control panel 160.

Figure 1C:
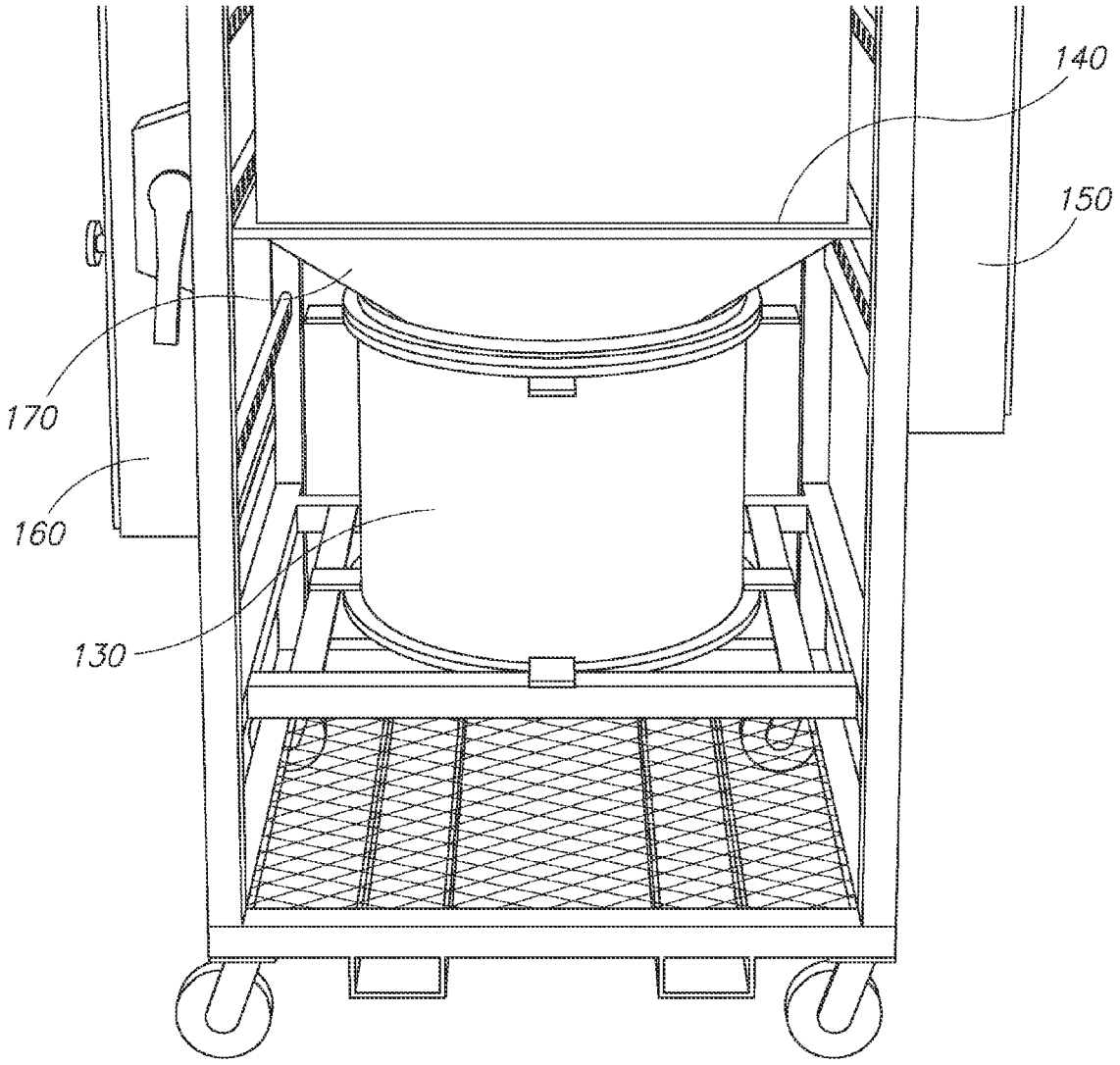
FIG. 1C illustrates a close-up view of a mobile system used to simulate thermal loads generated by electronic hardware devices.

FIG. 1C illustrates a close-up view of a mobile system used to simulate thermal loads generated by electronic hardware devices that is consistent with the embodiments disclosed herein. In certain embodiments, the thermal energy source control panel 150 and the airflow assembly control panel 160 are on opposite sides of the mobile system. However, other embodiments are not so constrained, and the electronics to control both the thermal energy source and the airflow assembly 130 may be housed within the same panel. The one or more control panels may be positioned anywhere on the supporting frame. FIG. 1C shows integrating duct 170 integrating or coupling airflow assembly 130 with air duct 140.

Figure 2:
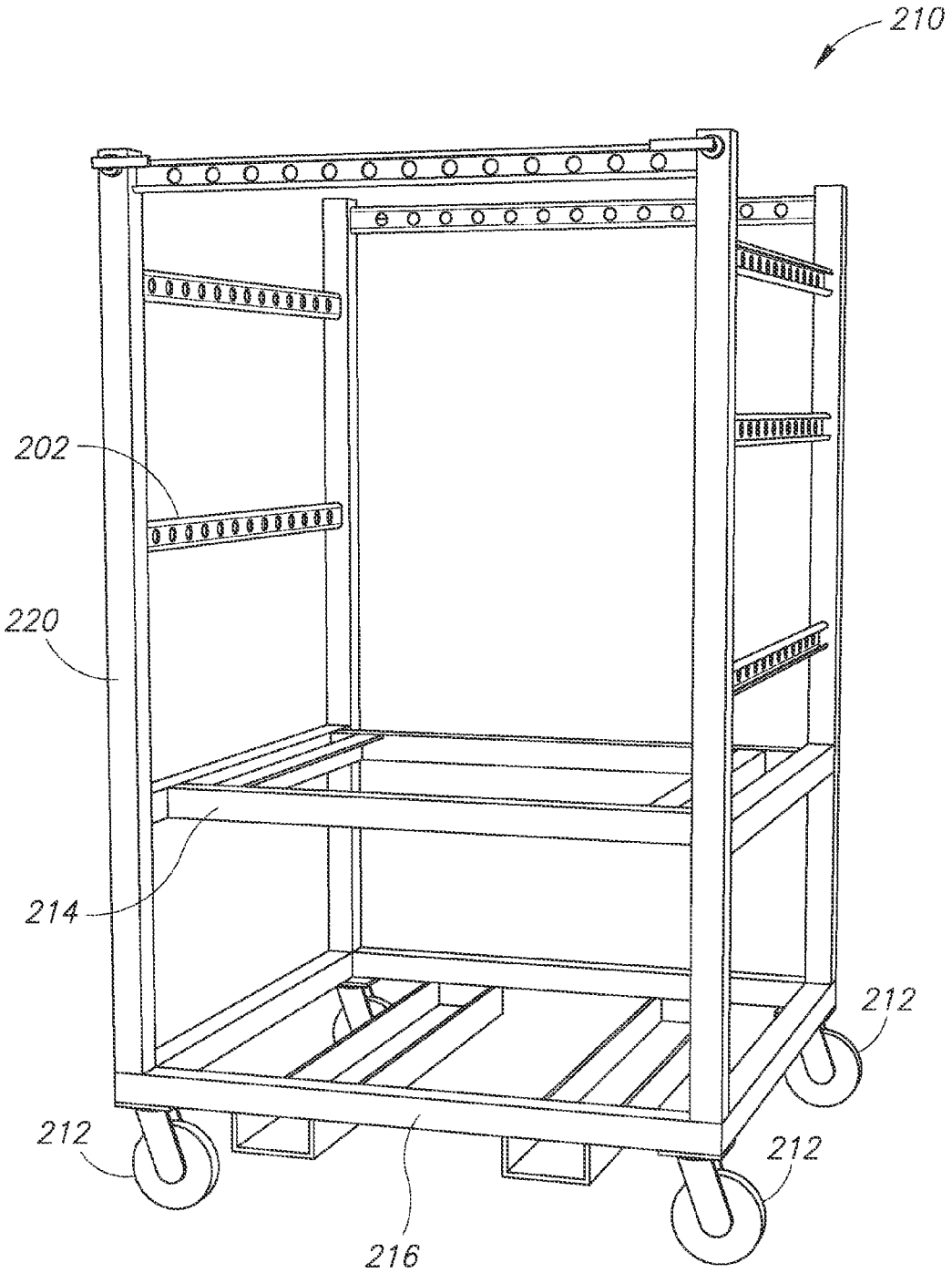
FIG. 2 shows a frame included in a mobile system used to simulate thermal loads generated by electronic hardware devices.

FIG. 2 shows a frame 210 included in a mobile system used to simulate thermal loads generated by electronic hardware devices. In various embodiments, frame 210 is a cart. Frame 210 includes a plurality of vertical members 220, a horizontal lower shelf 216 and a horizontal airflow assembly shelf 214. The airflow assembly shelf 214 may at least partially support an airflow assembly. A plurality of caster-style wheels 212 enable the mobility of frame 210. Frame 210 preferably includes a plurality of horizontal members 202, which may be modular members, such as Unistrut® members. In some embodiments, at least one vertical member 220 is a modular member.

FIG. 3 shows an airflow assembly 330 included in a mobile system used to simulate thermal loads generated by electronic hardware devices. In a preferred embodiment, airflow assembly 330 is a fan assembly that includes a fan body or fan housing 332. A plurality of coupling or mounting brackets 338 enable the coupling of airflow assembly 330 to a system frame, such as frame 210 of FIG. 2. At least one coupling bracket 338 is coupled to an airflow assembly shelf, such as horizontal airflow assembly shelf 214 of FIG. 2.

Airflow assembly 330 includes an impeller having at least one blade or rotor 334. Although four impeller blades 334 are shown in FIG. 3, it is to be understood that an impeller could include more than or less than the four impeller blades 334. Impeller blades 334 rotate about a rotation axis 336 to induce an airflow through a mobile system, such as mobile system 100 of FIGS. 1A and 1B. Airflow assembly 330 includes a motor to drive the rotation of blades 334. In a preferred embodiment, the motor is an inline electric motor, such that the motor is housed within a housing 332 and lies along rotation axis 336. In other embodiments, the motor is external to housing 332.

Figure 4B:
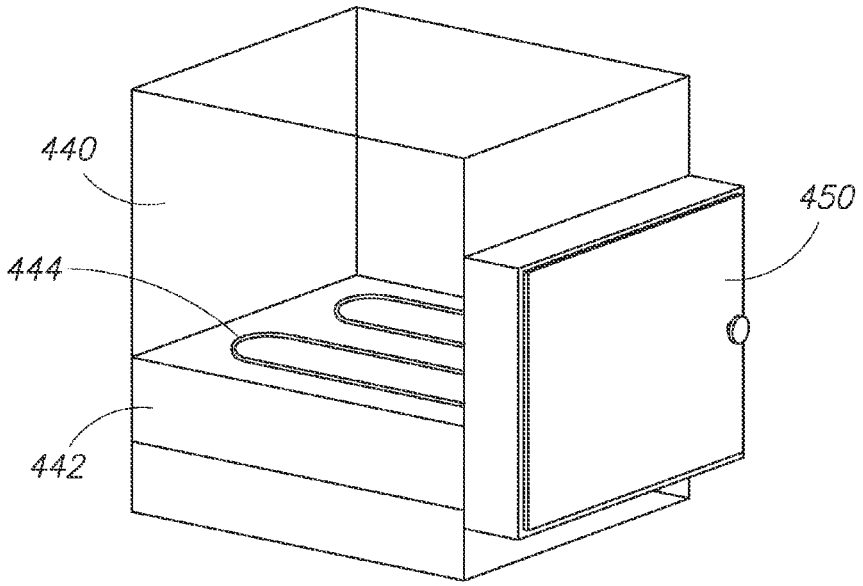
FIG. 4B shows a thermal energy source configured to heat the air within an air duct.

FIG. 4A shows thermal energy source 442 included in a mobile system used to simulate thermal loads generated by electronic hardware devices. In a preferred embodiment, thermal energy source 442 is a duct heater. As shown in FIG. 4B, a duct heater is configured to heat air within an air duct. Thermal energy source 442 includes a thermal energy source housing 448 that is configured to be positioned within an air duct.

In at least one embodiment, as described with reference to FIG. 4A, thermal energy source 442 is an electrical resistive heater and includes a plurality of electrical resistive heating elements 444. As such, an electrical current passes through heating elements 444. The flow of electrical current through heating elements 444 is impeded by the electrical resistance within heating elements 444 and generates thermal energy. In a preferred embodiment, thermal energy source 442 includes a safety grate 446 to protect heating elements 444.

FIG. 4B shows a thermal energy source 442 configured to heat the air within an air duct 440. Air duct 440 may be similar to air duct 140 of FIGS. 1A-1C. Thermal energy source 442 includes heating elements 444. At least a portion of the electronics that control the thermal output of thermal energy source 442 are housed within a thermal energy source control panel 450, which may be similar to thermal energy control panel 150 of FIGS. 1A-1C.

In a preferred embodiment, and as showing in FIG. 4B, heating elements 444 are oriented substantially transverse to the direction of airflow in air duct 440. This relative orientation improves heat transfer from thermal energy source 442 to the air within air duct 440. Other embodiments are not so constrained and other configurations are possible.

Figure 5:
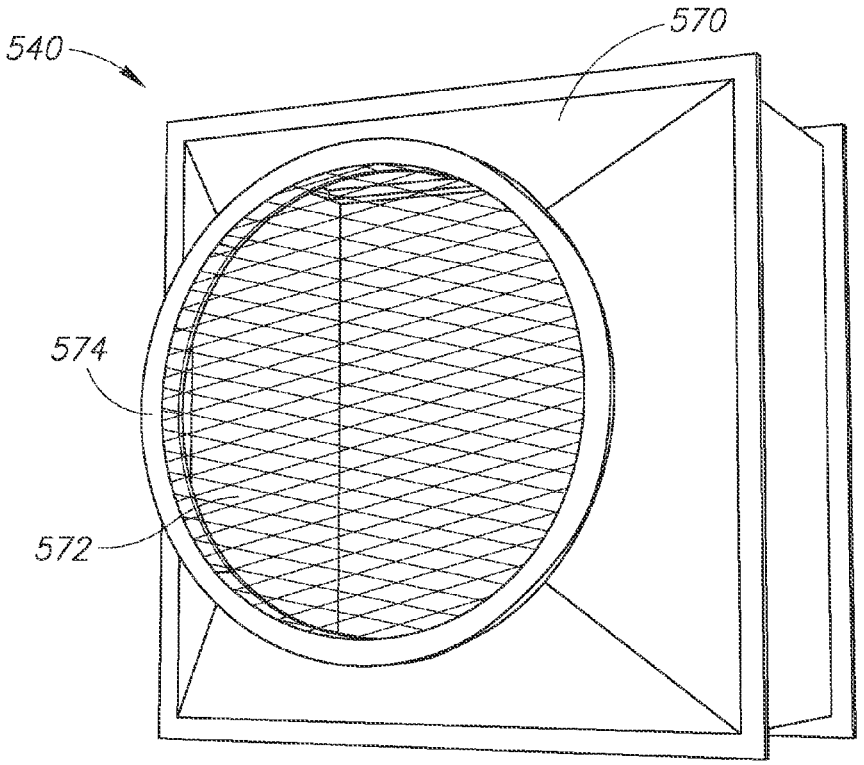
FIG. 5 shows an air duct coupled to an integrating duct. Both ducts are included in a mobile system used to simulate thermal loads generated by electronic hardware devices.

FIG. 5 shows an air duct 540 coupled to an integrating duct 570. Both ducts are included in a mobile system used to simulate thermal loads generated by electronic hardware devices. Air duct 540 may be similar to air duct 140 and integrating duct 570 may be similar to integrating duct 170, both described previously with reference to FIGS. 1A-1C.

Integrating duct 570 includes an aperture 574 configured to selectively receive and couple to an airflow assembly, such as airflow assembly 330 of FIG. 3. Such a coupling enables fluid communication between the airflow assembly, a thermal energy source such as thermal energy source 442 of FIGS. 4A-4B, and an output port of a mobile system such as mobile system 100 of FIGS. 1A-1B. In a preferred embodiment, integrating duct 570 is vertically above the coupled airflow assembly and includes a safety grate 572 to prevent objects from falling onto the blades of an impeller included in the airflow assembly. Because of the vertical orientation of a mobile system, such as mobile system 100 of FIGS. 1A-1B, safety grate 572 prevents damage to the rotating parts of an airflow assembly.

FIG. 6 shows a schematic view of a variable frequency drive unit (VFD) included in a mobile system used to simulate thermal loads generated by electronic hardware devices that is consistent with the various embodiments disclosed herein. An AC input signal serves as an input signal to the VFD. This AC input signal may originate from a wall power outlet or the facility's PDU, and provides at least electrical power to the VFD.

Based on user instructions, provided through an operator interface, the VFD generates an output signal. The frequency of the output signal is based upon user instructions. The user instructions may include at least one of the expected airflow or the expected air temperature based on the expected thermal load of a data center. The output signal is provided to an electric motor that converts the output signal to mechanical power. In the embodiment shown in FIG. 6, output signal drives an airflow assembly at a frequency that is based upon the user instructions.

In a preferred embodiment, the VFD generates the output signal by at least modulating the frequency of the input signal. The VFD may modulate an amplitude of the input signal. As shown in FIG. 6, the output signal may be a digital signal. In other embodiments, the output signal may be an analog signal. As discussed above, a determination of the actual flow rate through an output port, such as the upper frame portion of FIGS. 1A-1B, as well as the expected value may serve as inputs for an airflow feedback loop. The modulation of the output signal may be based on the actual flow rate. In a preferred embodiment, at least the frequency of the output signal is based upon a comparison of the actual flow rate to a determined expected flow rate.

FIG. 7 illustrates an isometric view of mobile system 700 where the vertical height of the output port is adjusted to a minimum height. In comparison, another embodiment of a mobile system 100 is showing in FIGS. 1A-1B, where the height of the output port is adjusted to a maximum. In the embodiments shown in FIGS. 1A-1B and FIG. 7, the vertical height of the output port is defined by the vertical height of upper frame portion 118 and 718, respectively. A collapsible duct portion 728 is collapsed to accommodate the adjustment to the minimum height. A plurality of pins 726 couple or fasten the collapsible duct portion 728 to the telescoping vertical frame members. When adjusted in the downward direction, the telescoping vertical members slide into the interior regions of vertical frame members 722. According, only a small portion of the telescoping vertical frame members is visible in FIG. 7. Levers 724 are used to secure the height of the telescoping vertical frame members. A frame handle 708 telescopes downward and into the system frame when the vertical height of upper frame portion 718 is downwards adjusted.

Figure 8:
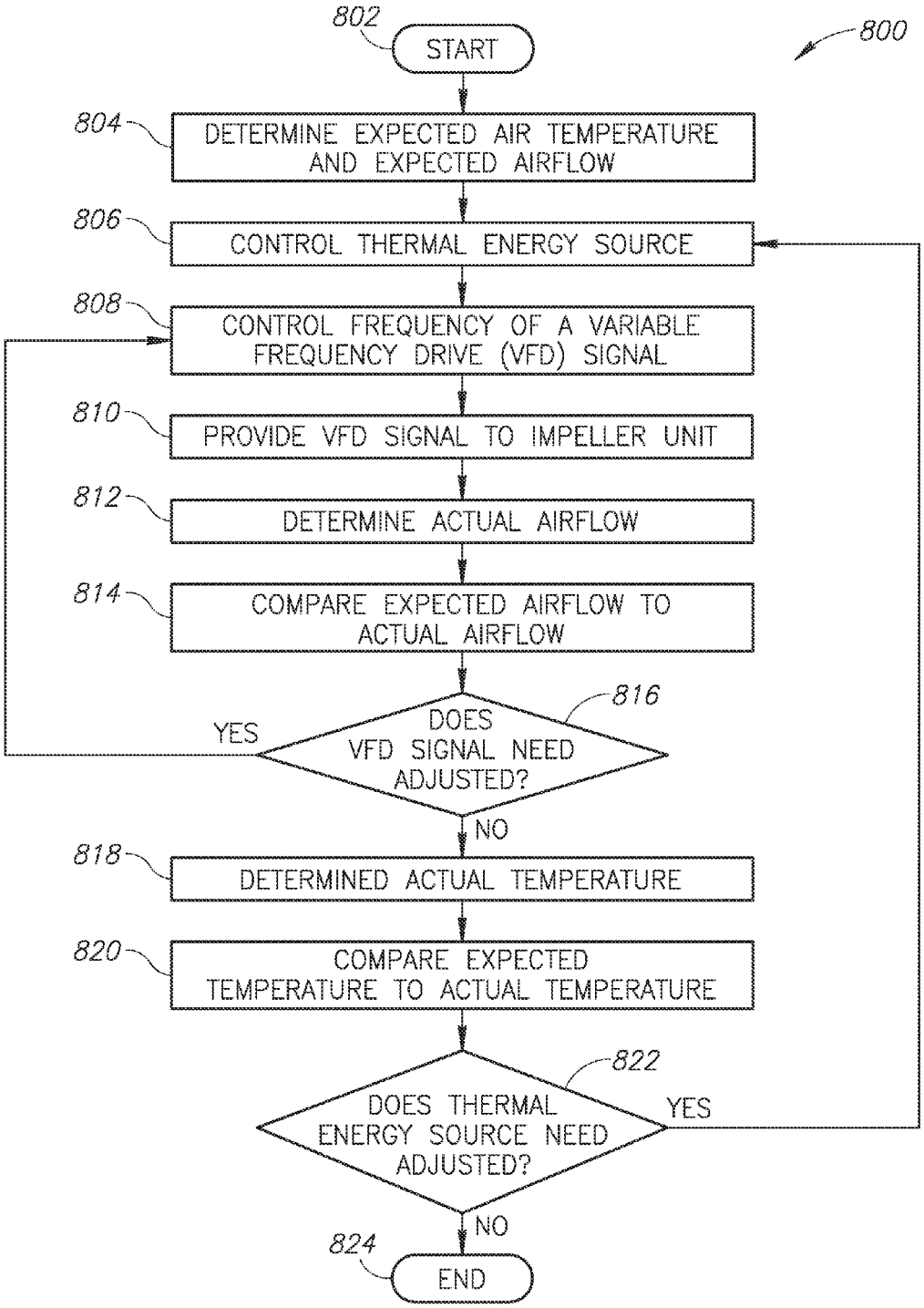
FIG. 8 shows a method for commissioning a data center.

FIG. 8 shows a method 800 for commissioning a data center. In a preferred embodiment, method 800 is at least partially implemented on a mobile system, such as the mobile system 100 shown in FIGS. 1A-1B. As described below, some of the steps of method 800 employ a processor device included in the mobile system.

Method 800 begins at start block 802. At block 804, an expected air temperature and airflow rate is determined. In various embodiments, the expected air temperature is based on the expected computer inlet air temperature when the data center's electronic equipment is operating. The expected airflow rate may be based on the expected airflow when the electronic equipment is operating. At least one of the expected air temperature or the expected airflow rate is based on a hardware utilization factor. A hardware utilization factor may be based on at least one of a type of electronic device, an operational speed of an electronic device, a density of electronic devices, a utilization frequency of the electronic devices, and the like.

At block 806, a thermal energy source is controlled. In a preferred embodiment, controlling the thermal energy source includes controlling the thermal energy source's power output. The energy source is configured to heat air, such as air within an air duct of the mobile system. Controlling the thermal energy source may be based on the determined expected air temperature. In at least one embodiment, controlling the thermal energy source is based on an actual air temperature, such as the actual air temperature determined in block 818. In preferred embodiments, controlling the thermal energy source is based on a comparison of the expected air temperature to the actual air temperature, such as the comparison performed in block 820.

In various embodiments, the thermal energy source is integrated into a mobile system that at least partially implements method 800. A user may input or otherwise program the expected air temperature and the expected airflow into at least one processor device included in the mobile system. The mobile system is strategically positioned within a potential facility during the commissioning of the data center to carry out testing of the facility. Controlling the thermal energy source may include controlling the heat output of the thermal energy source in real time. In various embodiments, the thermal energy source is at least partially controlled by the processor device.

At block 808, a frequency of a VFD signal is controlled. The VFD signal is configured to drive an airflow assembly, included in the mobile system, such as airflow assembly 130 of FIGS. 1A-1C. Preferably, the VFD is included in the mobile system. The processor device may at least partially control the VFD. In various embodiments, the frequency of the VFD signal is controlled based on the determined expected airflow. The frequency of the VFD signal may be controlled based on an actual airflow, such as the actual airflow determined at block 812. In preferred embodiments, controlling the frequency of the VFD signal is based on a comparison of the expected airflow to the actual airflow, such as the comparison performed in block 814. At block 810, the VFD signal is provided to the airflow assembly. The airflow assembly includes an impeller unit that induces the airflow through the mobile system.

At block 812, an actual airflow is determined. In a preferred embodiment, determining the actual airflow includes determining the flow rate of air flowing out of the mobile system through an output port. In at least one embodiment, the airflow is determined with an airflow meter positioned adjacent to the output port. In at least one embodiment, the determined actual airflow is provided to the processor device. At block 814, the actual airflow of block 812 is compared to the expected airflow of block 804. In a preferred embodiment, the comparison is performed by the mobile system's processor device.

At decision block 816, a decision is made whether an adjustment of the VFD signal is required. The decision at block 816 may be based on the comparison performed at block 814. For instance, if the actual airflow substantially corresponds to the expected airflow, no adjustment of the VFD signal's frequency is required and method 800 proceeds to block 818. If the actual airflow is not within a predetermined airflow tolerance of the expected airflow, the frequency of the VFD's signal requires adjustment and method 800 proceeds to block 808.

Decision block 816 establishes an airflow feedback loop, which may be at least be partially implemented by the processor device of the mobile system. In particular, the decision of block 816 may be implanted by a processor device included in the VFD. The user may input or otherwise program the predetermined airflow tolerance into the processor device.

At block 818, an actual air temperature is determined. In preferable embodiments, determining the actual air temperature includes determining the air temperature of air flowing through the output port of the mobile system. In at least one embodiment, a temperature sensitive device, such as a thermistor or digital thermometer is employed to determine the actual air temperature. In at least one embodiment, the determined actual air temperature is provided to the processor device. At block 820, the actual air temperature is compared to the expected air temperature. The processor device may perform the comparison.

At decision block 822, a decision is determined whether an adjustment of the thermal energy source is required. The processor device may make the decision. In preferred embodiments, the decision is based on at least the comparison performed at block 820. For instance, if the actual air temperature substantially corresponds to the expected air temperature, no adjustment of the thermal energy source is required. When the commission test is complete, method 800 concludes at block 824. If the actual air temperature is not within a predetermined air temperature tolerance of the expected air temperature, the thermal energy source requires adjustment and method 800 proceeds to block 806. Decision block 822 establishes an air temperature feedback loop within the predetermined tolerance. A user may input or otherwise program the predetermined air temperature tolerance into a processor device of the mobile system.

All of the embodiments and methods disclosed and claimed herein can be made and executed without undue experimentation in light of the present disclosure. While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A mobile system for simulating a thermal and airflow load expected in operation of a data center, the system comprising:

a thermal energy source configured to provide thermal energy to air adjacent to the thermal energy source;

an impeller oriented substantially horizontal and configured to control a flow rate of the air adjacent to the thermal energy source such that the air adjacent to the thermal energy source flows in a vertically upward direction;

a safety grate to protect at least one of the impeller or the thermal energy source;

an output port positioned vertically above the impeller and oriented substantially horizontal, wherein the output port is configured to output the vertically flowing air;

an impeller drive unit configured to drive the impeller at a rotational frequency that is varied during operation of the system based on a comparison of a predetermined airflow range and an actual airflow through the output port, wherein the actual airflow is monitored during the operation of the system by an airflow meter that is positioned either adjacent or within the output port, wherein the predetermined airflow range corresponds to the airflow load expected in the operation of the data center and a predetermined airflow tolerance;

a frame configured to support the thermal energy source, the impeller, the output port and the drive unit;

a collapsible duct to accommodate a variable height of the frame; and a plurality of ground engaging members supporting the frame and configured to enable mobility of the system, wherein the impeller drive unit is further configured to vary the rotational frequency of the impeller during the operation of the system so that the actual airflow through the output port substantially matches the predetermined airflow range so that the airflow load expected in the operation of the data center is substantially simulated.

2. The system of claim 1, further comprising a duct to direct the flowing air through the output port.

3. The system of claim 1, further comprising a thermal energy source drive unit configured to control an amount of thermal energy provided to the air adjacent to the thermal energy source based on a predetermined temperature of the air outputted at the output port.

4. The system of claim 1, further comprising an interlock switch that inhibits an operation of the thermal energy source when a temperature of the thermal energy source is greater than a predetermined temperature threshold or an airflow across the thermal energy source is less than a predetermined airflow threshold.

5. The system of claim 1, wherein a vertical height of the output port is adjustable.

6. The system of claim 1, further comprising a power cord to provide electrical power while the system is mobile during operation.

7. The system of claim 1, wherein a cross section of the output port is adjustable.

8. A cart for commissioning a data center, the cart comprising:

a duct that includes a first end and a second end;

a duct heater configured to heat air flowing through the duct;

a fan oriented substantially horizontal and configured to induce the flow of air through the duct, wherein the flow of air through the duct is in a vertically upward direction;

an output port positioned vertically above the fan and oriented substantially horizontal, wherein the output port is coupled to the second end of the duct;

a variable frequency drive (VFD) to drive the fan at a rotational frequency based on a comparison of a predetermined airflow range and an actual airflow through the output port, wherein the actual airflow is monitored by an airflow meter that is positioned either adjacent or within the output port, wherein the predetermined airflow range corresponds to an airflow load expected during the operation of the data center and a predetermined airflow tolerance;

a frame that includes a plurality of telescoping frame members, the frame is configured to support the duct, the duct heater, the fan and the output port, wherein the plurality of telescoping frame members are coupled to the output port and the first end of the duct is coupled to at least one of the frame, the duct heater, or the fan, and wherein a vertical height of the plurality of telescoping frame members is adjustable to enable a user to vary the vertical position of the output port; and a plurality of wheels supporting the frame and configured to enable the translation of the cart to a plurality of positions within the data center, wherein the VFD varies the rotational frequency of the fan so that the actual airflow through the output port substantially matches the predetermined airflow range so that the airflow load expected in the operation of the data center is substantially simulated.

9. The cart of claim 8, wherein an effective length of at least a portion of the duct is adjustable to accommodate a variable vertical height of the output port.

10. The cart of claim 8, further comprising a switch that prevents the operation of the duct heater when a temperature of the duct heater is greater than a predetermined temperature threshold or an airflow across the duct heater is less than a predetermined airflow threshold.

* * * * *